United States Patent [19]

Howlett

[11] 4,107,644

[45] Aug. 15, 1978

[54] SYSTEM AND METHOD FOR DIGITALLY TRANSMITTING WELL LOGGING INFORMATION

[75] Inventor: Donald L. Howlett, Houston, Tex.

[73] Assignee: Texaco Inc., New York, N.Y.

[21] Appl. No.: 750,746

[22] Filed: Dec. 15, 1976

[51] Int. Cl.[2] ..... G01V 1/40

[52] U.S. Cl. ..... 340/18 CM; 340/18 P; 179/15 BS

[58] Field of Search ..... 340/18 P, 18 R, 18 CM; 179/15 BS

[56] References Cited

U.S. PATENT DOCUMENTS

| | | | |
|---|---|---|---|
| 3,657,694 | 4/1972 | Lindsey | 340/18 CM |
| 3,707,700 | 12/1972 | Lafont | 340/18 P |
| 3,725,857 | 4/1973 | Pitts, Jr. | 340/18 CM |
| 3,821,696 | 6/1974 | Harrell et al. | 340/18 P |
| 3,824,533 | 7/1974 | Adamson | 340/18 P |
| 3,959,767 | 5/1976 | Smither et al. | 340/18 P |
| 3,980,881 | 9/1976 | Veach et al. | 340/18 CM |
| 3,991,611 | 11/1976 | Marshall et al. | 340/18 P |
| 4,012,712 | 3/1977 | Nelligan | 340/18 CM |

*Primary Examiner*—Howard A. Birmiel
*Attorney, Agent, or Firm*—Thomas H. Whaley; Carl G. Ries; Ronald G. Gillespie

[57] ABSTRACT

A data transmission system, for a well logging system having a logging tool logging a borehole traversing an earth formation and surface equipment adjacent to the borehole for making a well log, includes a sync word generator located in the logging tool, which periodically provides a predetermined digital signal corresponding to at least one sync word. A phase encoder located in the logging tool receives the data in serial digital form and the sync word. The phase encoder provides a phase encoded signal, corresponding to the data and to the sync word, at a predetermined frequency. A cable drive receives the phase encoded signal and provides it to a cable for transmissin up-hole. The surface equipment includes a phase decoder connected to the cable for decoding the phase coded signal to provide at a serial digital signal. An output circuit at the surface provides parallel digital signals in accordance with the serial digital signal corresponding to the sync words and the data.

4 Claims, 15 Drawing Figures

DOWNHOLE SURFACE
TIMING & CONTROL SIGNAL MEANS
50
SENSING MEANS
1
ENTER
$\bar{T}_0$
PARALLEL TO SERIAL CONVERTER
60
$T_0$
$T_2$
PHASE ENCODER
72
CABLE DRIVER
90
CABLE
92
BANDPASS FILTER
95
LOWCUT FILTER
100
$T_1$
MAJORITY BIT MEANS
70
$E_1$
SQUARING AMP.
105
$E_3$
PHASE DECODER
107
OUTPUT MEANS
40
RECORDING MEANS

SYSTEM AND METHOD FOR DIGITALLY TRANSMITTING WELL LOGGING INFORMATION

BACKGROUND OF THE INVENTION

1. Field of the Invention

The present invention relates to transmission systems and methods in general and, more particularly, a well logging transmission system and method.

2. Summary of the Invention

A data transmission system for a well logging system having a logging tool logging a borehole traversing an earth formation and surface equipment adjacent to the borehole for making a well log, comprising a sync word generator located in the logging tool which periodically provides a predetermined digital signal corresponding to at least one sync word. A phase encoder located in the logging tool receives serial digital information related to the earth formation and to the sync words from the generator. The phase encoder provides a phase encoded signal corresponding to the data and to the sync word. A netword provides the phase encoded signal corresponding to the data and to the sync word. A network provides the phase encoder signal to a cable for transmission up-hole. A phase encoder at the surface receives the transmitted signal and decodes it to provide a serial digital signal. An output circuit converts the serial digital signal to parallel digital signals corresponding to the information and to the sync words.

The objects and advantages of the invention will appear more fully hereinafter, from a consideration of the detailed description which follows, taken together with the accompanying drawings wherein one embodiment is illustrated by way of example. It is to be expressly understood, however, that the drawings are for illustrative purposes only and are not to be construed as defining the limits of the invention.

DESCRIPTION OF THE INVENTION

Figure 1:
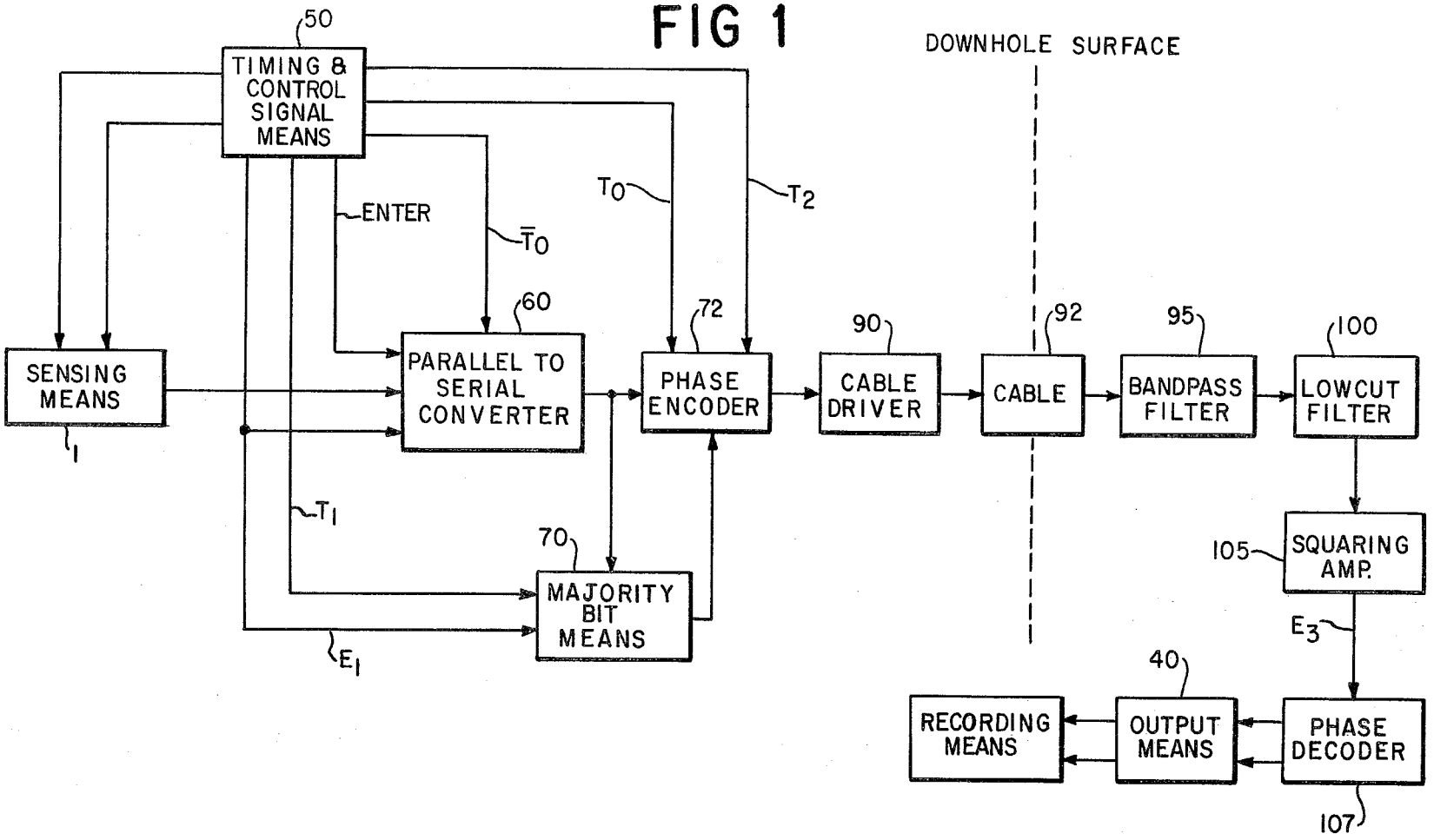
FIG. 1 is a simplified block diagram of a well logging system including a data transmission system constructed in accordance with the present invention.

Referring to FIG. 1, there is shown sensing means 1 sensing at least one condition in a borehole and providing parallel digital signals corresponding to the sensed condition. It would be obvious to one skilled in the art that sensing means 1 may sense more than one condition, and the present invention would still be operative.

Figure 2:
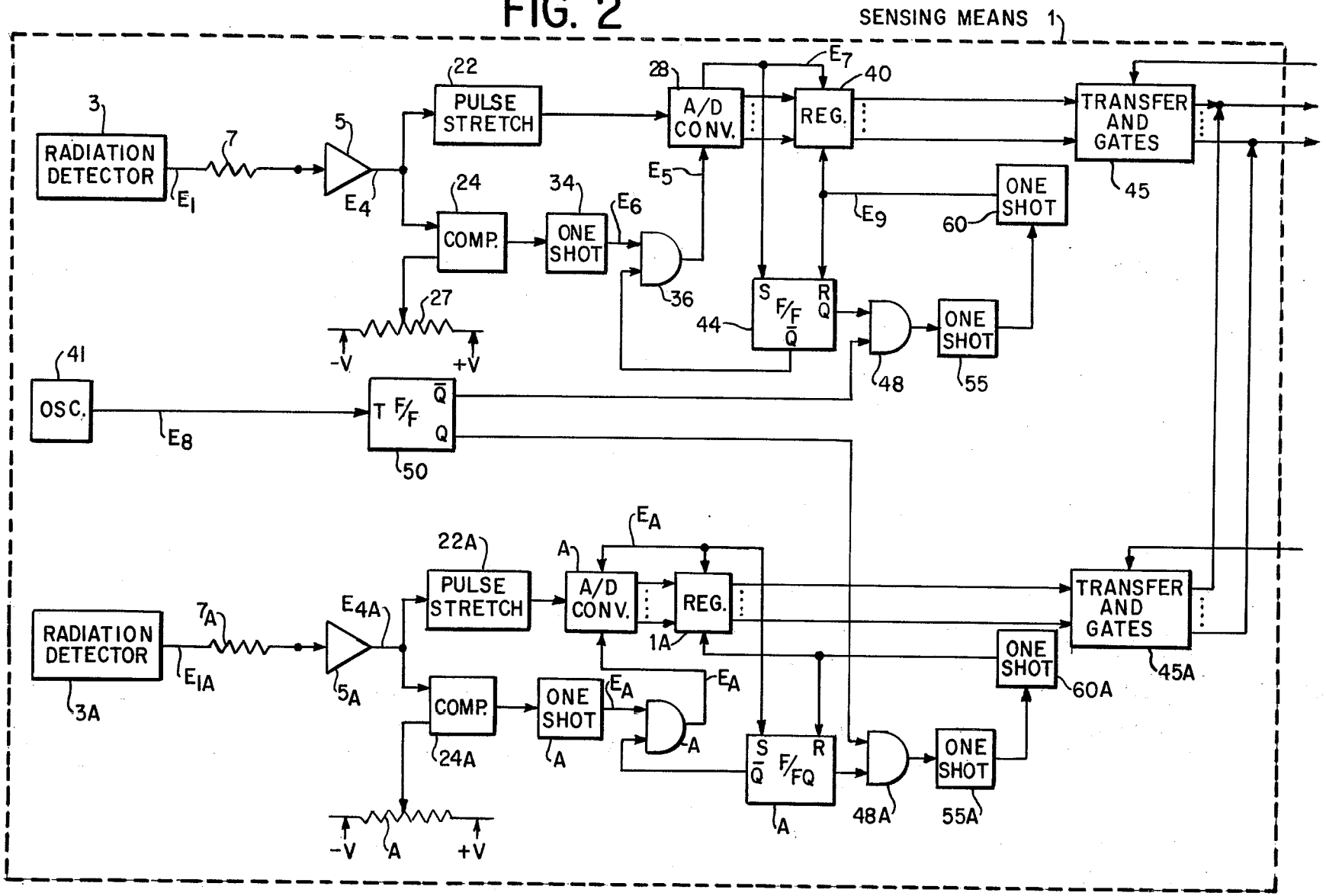
FIGS. 2 and 3 are detailed block diagrams of the sensing means and the timing and control signal means, respectively, shown in FIG. 1.

Sensing means 1 can be any arrangement of sensors and associated circuitry which provide digital signals. For explanation purposes, sensing means 1 is shown in FIG. 2 as being similar to the logging tool components disclosed and described in U.S. application Ser. No. 643,261, filed on Dec. 22, 1975 and assigned to Texaco Inc., assignee of the present invention.

Radiation detectors 3, 3A, which may be of a conventional type, in sensing means 1, detect gamma radiation and provide electrical data pulses $E_1$ and $E_{1A}$, respectively, corresponding in peak amplitude and number to detected gamma radiation. Elements identified by a number with a suffix are connected and operate in a similar manner as elements having the same number without a suffix. The detected gamma radiation is relative to at least one condition of an earth formation having a borehole into which sensing means 1 has been inserted. Data pulses $E_1$, $E_{1A}$ are provided to pre-amps 5 and 5A, respectively, through resistors 7 and 7A, respectively. Pre-amp 5, 5A provide amplified data pulses $E_3$ and $E_{2A}$, respectively.

Pulse signal $E_4$ is applied to a pulse stretcher 22 and to a comparator 24. Comparator 24 functions as a low level discriminator by comparing each pulse in pulse signal $E_4$ with a reference level. The level is obtained by applying reference voltages $+V$ and $-V$ across a potentiometer 27, and applying the wiper arm voltage to comparator 24. Adjustment of the wiper arm of potentiometer 27 sets the reference level. Comparator 24 provides a pulse when a pulse in pulse signal $E_4$ occurs which is greater than a threshold value as defined by the reference level.

The stretched pulses provided by pulse stretcher 22 are applied to analog-to-digital converter 28 which may be of the type sold by Teledyne-Philbrick as their Part No. 4109/410910. However, converter 28 will not convert the analog signal to digital signals until it receives an "enter" pulse $E_5$.

Each "enter" pulse $E_5$ is derived from a pulse from comparator 24 as follows. The trailing edge of a pulse from comparator 24 triggers a one-shot multivibrator 34 to provide a pulse $E_6$ to an AND gate 36. When AND gate 36 is enabled, as hereinafter explained, the pulse from one-shot 34 is provided as "enter" pulse to converter 28.

Upon the occurrence of an "enter" pulse $E_5$, the stretched pulse from pulse stretcher $E_{22}$ is converted to digital signals, by analog-to-digital converter 28, which are provided to a register 40. Upon the end of conversion, converter 28 provides a pulse $E_7$ to register 40 for transferring the digital information into register 40 and to a flip-flop 44. Flip-flop 44 provides a $\overline{Q}$ output to AND gate 36 and a Q output to another AND gate 48. The $\overline{Q}$ output from flip-flop 44 goes to a low level in response to a pulse $E_7$ thereby disabling AND gate 36 to block any more pulses $E_6$ should they occur within a predetermined time period as hereinafter described.

The predetermined time period is controlled by the time between pulses of a pulse signal $E_8$ from an oscillator 41. Pulses $E_8$ are provided to a flip-flop 50 which is used to alternately control operations of the dual channels. The $\overline{Q}$ output of flip-flop 50 is applied to AND gate 48 so that upon the occurrence of a pulse $E_8$ from oscillator 41, AND gate 48 is enabled until a following pulse $E_8$ occurs. Flip-flop 44's Q output to AND gate 48 is at a high level as a result of the occurrence of a pulse $E_7$, so that the subsequent pulse $E_8$ from oscillator 41 disables AND gate 48 causing its output to go to a low level triggering a one-shot multivibrator 55.

One-shot 55 provides a positive pulse whose negative going edge is used to trigger another one-shot multivibrator 60 which provides a reset pulse $E_9$ to flip-flop 44 and register 40. Pulse $E_8$ resets register 40 and opens AND gate 36 which will enable the next selected pulse to be converted by converter 28. It can be seen that the first selected data pulse occurring during one cycle of the frequency of oscillator 41 prevents subsequent pulses occurring in that period from affecting the data.

While the channel is in operation, the output from register 40 is applied to transfer AND gates 45 controlled by a multiplexing signal $E_{10}$ as hereinafter explained.

Upon the occurrence of a subsequent pulse $E_8$ from oscillator 41, the other channel operates in a similar manner as the channel heretofore described. It is again noted that those elements having a number and a suffix, comprise the other channel and operate in a similar manner as the elements having the same number without a suffix.

The outputs of transfer AND gates 45, 45A are connected so that sensing means, in response to the multiplexing signals, provides either the signals from register 40 or from 40A as its output signals.

The multiplexing signals are provided to sensing means 1 by timing and control signal means 50.

Figure 3:
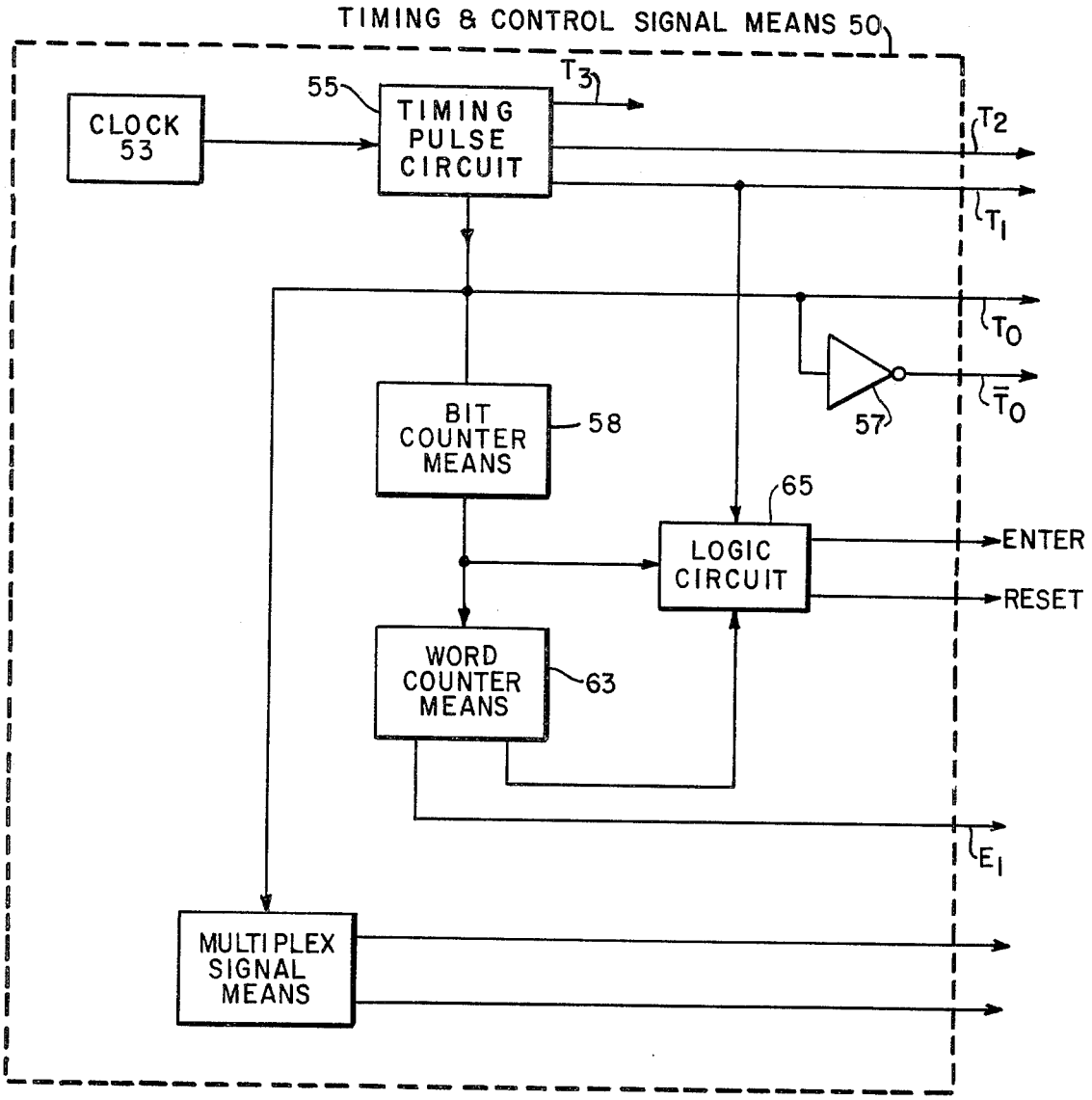

Referring now to FIG. 3, signal means 50 includes a clock 53 providing clock pulses to a timing pulse circuit 55 which provides timing pulses $T_0$ through $T_3$ shown in FIGS. 4A through 4D. Timing pulses $T_0$ are provided to an inverter 57 and to a bit counter means 58. Inverter 57 provides $\overline{T_0}$ pulses, which are used as shift pulses, to a parallel serial converter 60. Counter means 58 in counting pulses $T_0$ is in effect counting bits at the proper number of bits which constitutes a word, bit counter means provide a pulse output to word counter means 63 and to a logic circuit 63. Word counter means 63 provides two outputs which are the opposite of each other after counting a certain number of words. In operation the number of words chosen before synchronization as hereinafter explained, is 32 words. The first two words of each 32 word cycle are used as synchronization words as hereinafter explained. One of the signals provided by word counter means 53 is the signal $E_1$ which is used in the generation of the sync word as hereinafter explained.

Logic circuit 65 receiving timing pulse $E_1$ provides an "enter" signal which controls the entry of data in parallel to serial converter 60 as hereinafter explained and a reset pulse to majority bit means 70.

Referring now to FIG. 1, parallel-to-serial converter 60 is a register of the type which accepts parallel digital signal in response to an enter signal from timing and control means 50, and shift its contents serially in response to shift pulses $\overline{T_0}$ to effect a parallel-to-serial conversion.

During word 1 and word 2 of each cycle, converter 60 has been cleared so that word 1 and word 2 have all 0 bits which constitute the sync words. Two words of all zero bits have been selected for synchronization since it is conceivable that if only one word of 0 bits was used as a sync word the tail end of one word and the beginning of another word may have all zero bits during the shifting process and be erroneously interpreted as a sync word. Further, it is possible that during the data acquisition there may be a data word having all zero bits, but it is very rare to have two consecutive data words having all 0 bits.

During words 3 through 32 signal $E_1$ is of an amplitude which does not clear converter 60 and permits the entrance and shifting of data. The enter pulses from logic timing and control signal means 50 causes converter 60 to enter the parallel digital signals and the subsequent occurrence of $T_0$ pulses shifts the data words out of converter 60 to majority bit means 70 and to a phase encoder 72.

Majority bit means 70 essentially is a counter with some conventional logic circuitry, the details of which are not necessary to an understanding of the invention, which counts the one bits in the data word. It should be noted that the data word as used consists of nine bits although the invention is not restricted to that number of bits. The majority bit means 70 provide a majority bit to phase encoder 72 indicative of majority of bits in the data word. Thus, if the majority is one bits, means 70 provides a 1 bit as the ninth bit. This operation is very similar to that of a parity bit means.

Majority bit means 70 also receives timing pulse $T_1$ and signal $E_1$ from timing and control signal means 50. The purpose of signal $E_1$ is to cause majority bit means 70 to provide a majority one bit during word 1 but not during word 0 so that the uniqueness of the sync words is further enhanced by the first sync word majority bit agreeing with all zeroes while the second sync word has a majority bit disagreeing with all 0 bits in the sync word. Thus if again by some pure chance two data words were to have all zero bits, the operation would be such that the majority bit provided during those two data words would be 0 bits whereas in the sync word operation the second sync word or word 1 of the cycle has a majority 1 bit.

The purpose of phase encoder 72 is to encode a digital signal provided by converter 60 for transmission uphole by logging cable in a manner so as to enhance the speed of transmission and to alleviate problems caused by distortion. This is accomplished by dividing each bit cycle into four segments defined by $T_0$, $T_1$, $T_2$ and $T_3$. It should be noted that in the description of timing and control signal means 50 timing pulses $T_3$ were not utilized. However, $T_3$ is necessary for establishing the four segment bit cell. The digital signal is operating so that the change of the signal provided by phase encoder 72 occurring in the middle of each bit cell determines whether the information being transmitted is a digital 1 or digital 0. .

Figures 4A, 4B, 4C, 4D, 4E, 4F, 4G, 4H, 4I:
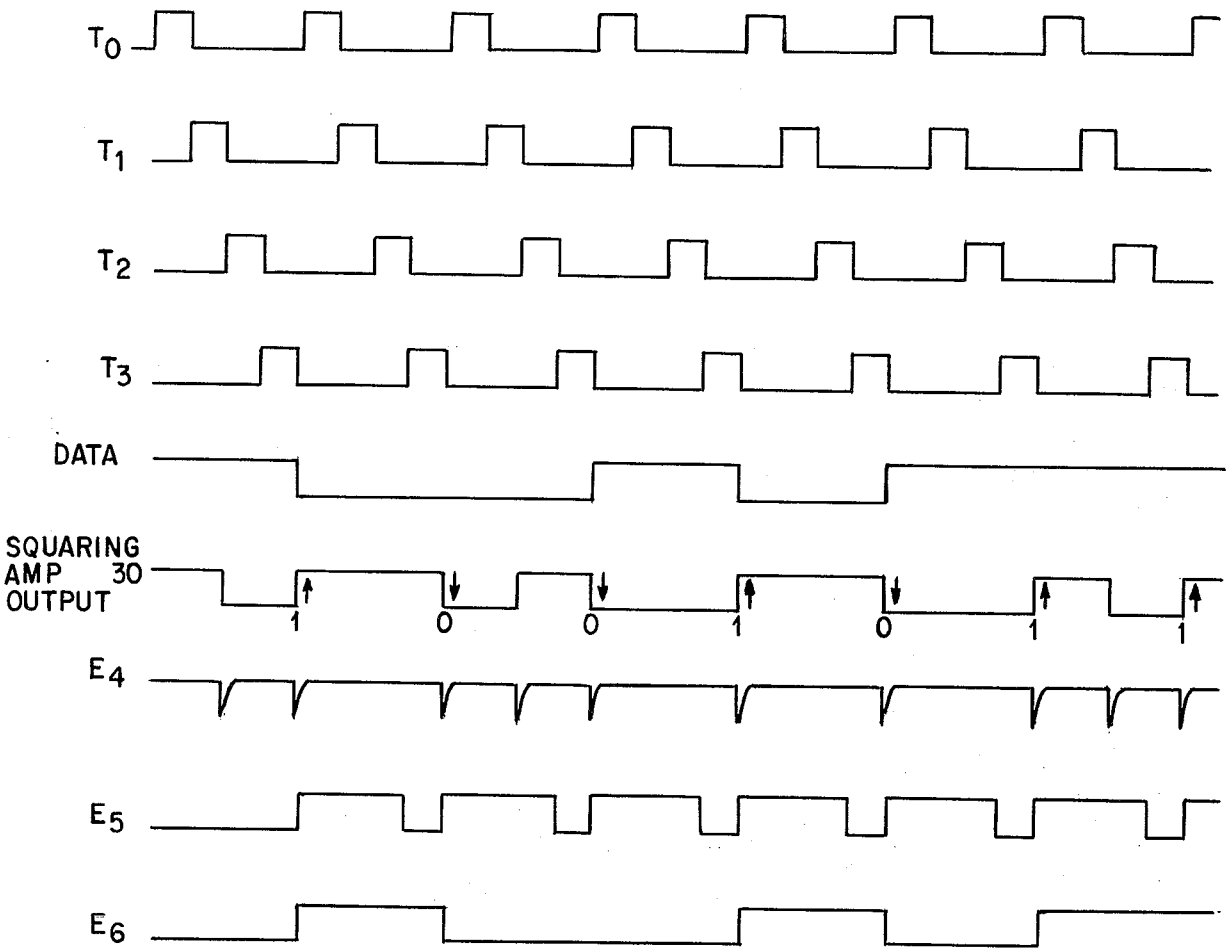
FIGS. 4A through 4I are graphical representations of voltages occurring during the operation of the system shown in FIG. 1.
Figure 5:
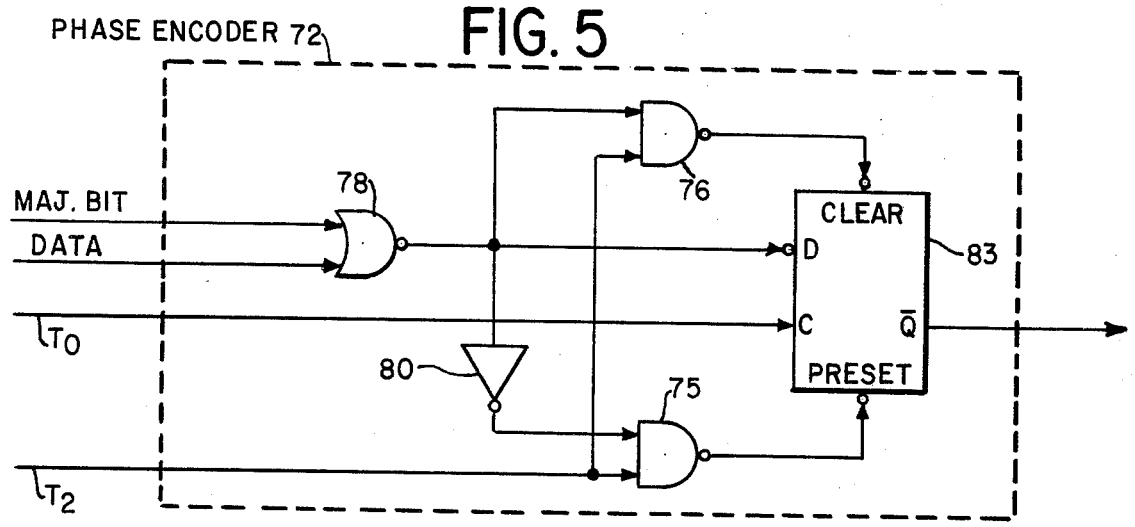
FIGS. 5, 6 and 7 are detailed block diagrams of the phase encoder, the phase decoder and the output means, respectively, shown in FIG. 1.

Referring to FIGS. 4E and 4F, it should be noted that those changes in the signal showing FIG. 4F having arrows alongside them are the changes occurring in the middle of bit cells. The middle of each bit cell occurs with the trailing edge of pulse $T_3$ and the leading edge of pulse $T_0$. A positive going change of the signal from phase encoder 72 at the middle of a bit cell is indicative of a digital 1 while a negative going change is indicative of a digital 0. To better understand this operation, let us assume that parallel serial converter 60 has provided a 7 bit digital word 1001011. Referring to FIG. 5 the first to appear pulse $T_2$ in FIG. 4C is applied to NAND gate 81, 76 while the data digital signal from converter 60 is applied to NOR gate 74. Thus, a one bit, shown in FIG. 4E, passes through NOR gate 74 to become a 0 bit which is applied to NAND gate 76, to an inverter 80 (which converts it back to a one bit) and to a D input of flip-flop 83. The output from inverter 80 is applied to NAND gate 75. The 0 bit from NOR gate 78 disables NAND gate 76 while the one bit inverter 80 enables NAND gate 75 so that upon the occurrence of the first $T_2$ pulse NAND gate 75 provides a negative going pulse to a preset input of flip-flop 83 while NAND gate 76 provides a high level signal to a clear input of flip-flop 83.

The operation of flip-flop 83 is such that the positive edge of a pulse applied to input C triggers flip-flop 83 to a state determined by the level of the signal applied to input D. When the D input is low, the $\overline{Q}$ output goes high in response to a $T_0$ pulse. When the D input is high, the $\overline{Q}$ output goes low in response to a $T_0$ pulse. The pulse from NAND gate 75 causes flip-flop 83 to provide its $\overline{Q}$ output at a high level.

The following $T_0$ pulse which is actually the second $T_0$ pulse shown in FIG. 4A, then triggers flip-flop 83 to a state determined by the output of NOR gate 78 which is at a low level. Thus the $\overline{Q}$ output goes to a high level resulting in a positive going change in the signal shown in FIG. 4F. It can be seen that the occurrence of the $T_2$ pulse determines logically the type of bit in the data word and that flip-flop 83 is then conditioned accordingly for the next subsequent $T_0$ pulse. The next subsequent $T_0$ pulse causes the proper change to indicate whether a 1 to 0 is being transmitted. The next data bit is a 0 so that NOR gate 78 provides a 1 bit which enables NAND gate 76 and the subsequent 0 bit provided by inverter 80 disabled NAND gate 75. The occurrence of the $T_2$ pulse has no effect for the simple reason that flip-flop 83 is already in the desired state. The next subsequent $T_0$ pulse (the 3rd $T_0$ pulse in FIG. 4A) causes flip-flop 83 $\overline{Q}$ output to go from a high level to a low level.

For a data signal as shown in FIG. 4E, flip-flop 83 provides a $\overline{Q}$ output as shown in FIG. 4F.

Referring to FIG. 1, the output of phase encoder 72 is provided to a cable driver 90 which amplifies the signal and applies it to a conventional type logging cable for transmission uphole. At the surface there is a conventional type band pass filter 95. Band pass filter 95 is not necessary to the present invention, however, it is in one contemplated use of the present invention, the transmission of data contains signals in the 500 kilohertzs to 1.0 megahertz range. In this embodiment the band pass filter permits the transmission of other data in other frequency bands over the same cable 92 without interference to the surface electronics portion of the transmission system. The output of band pass filter 95 is provided to a low cut filter which is utilized to compensate for the distortion induced by the use of the cable. Cable 92 represents a 350 kilohertzs high cut filter with a 36 db/octave slope. Low cut filter 100 approximates the inverse of the cable characteristics over the band width of the transmitter signal. Ideally, the filter 100 should be a 1.1 megahertzs low cut filter with a 36 db/octave slope. The signal from low cut filter 100 is applied to a squaring amplifier 105 which essentially restores the signal to a pulse signal $E_3$ of digital form as shown in FIG. 4F.

Figure 6:
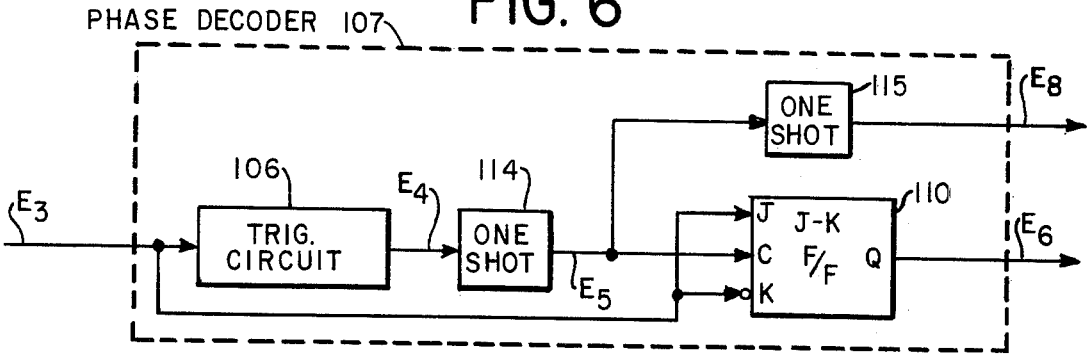

Signal $E_3$ from squaring amplifier 105 is applied to a phase decoder 107. The output from squaring amplifier 105 is provided to a trigger circuit 106 in phase decoder 107 as shown in FIG. 6 and to the J and K inputs of a J-K flip-flop 110. It should be noted that the little bubble in front of the K input indicates the K input is responsive to a negative signal. Trigger circuit 106 provides trigger pulses $E_4$, as shown in FIG. 4G, for every change in amplitude of the signal $E_3$. Signal $E_4$ is applied to a non-retriggable one-shot 114.

One-shot 114 triggers in response to trigger pulse $E_4$ but cannot be retriggered within a predetermined time period by another trigger pulse $E_4$. Since trigger pulses $E_4$ have a time relationship to timing pulses $T_0$ and $T_2$, and predetermined time period is such that one-shot 114 cannot be retriggered by a next subsequent $T_2$ pulse after being triggered by a $T_0$ pulse. Thus, when in initial operation, a trigger pulse $E_4$ corresponds in time to a $T_2$ timing pulse and triggers one-shot 114, one-shot will miss the $T_0$ trigger pulses; however, there arrives a point where there are no trigger pulses corresponding to a $T_2$ pulse. At that time the next subsequent trigger pulse which corresponds to timing pulse $T_0$ will trigger one-shot 114 and thereafter it will only be triggered by trigger pulses corresponding to $T_0$ pulses. One-shot 114 provides a pulse signal $E_5$ as shown in FIG. 4H. Pulses $E_5$ are applied to the clock input C of the J-K flip-flop 110.

Referring to FIGS. 4F, 4H and 4I, it can be seen that the first $E_5$ pulse shown occurs when the signal $E_3$ is at a high level. That combination causes flip-flop 110 to go to a set state providing signal $E_6$ at a high level.

The next subsequent pulse $E_5$ occurs when signal from amplifier 30 is at a low level which causes flip-flop 110 to provide its Q output $E_6$ at a low level. As can be seen from the relationship of FIGS. 4E and 4I, the digital word provided by signal $E_6$ corresponds to the digital data word provided by converter 60 downhole. Signal $E_6$ is also provided to a one-shot multivibrator 115 which provides a pulse signal $E_8$ in response to pulses $E_5$.

Figure 7:
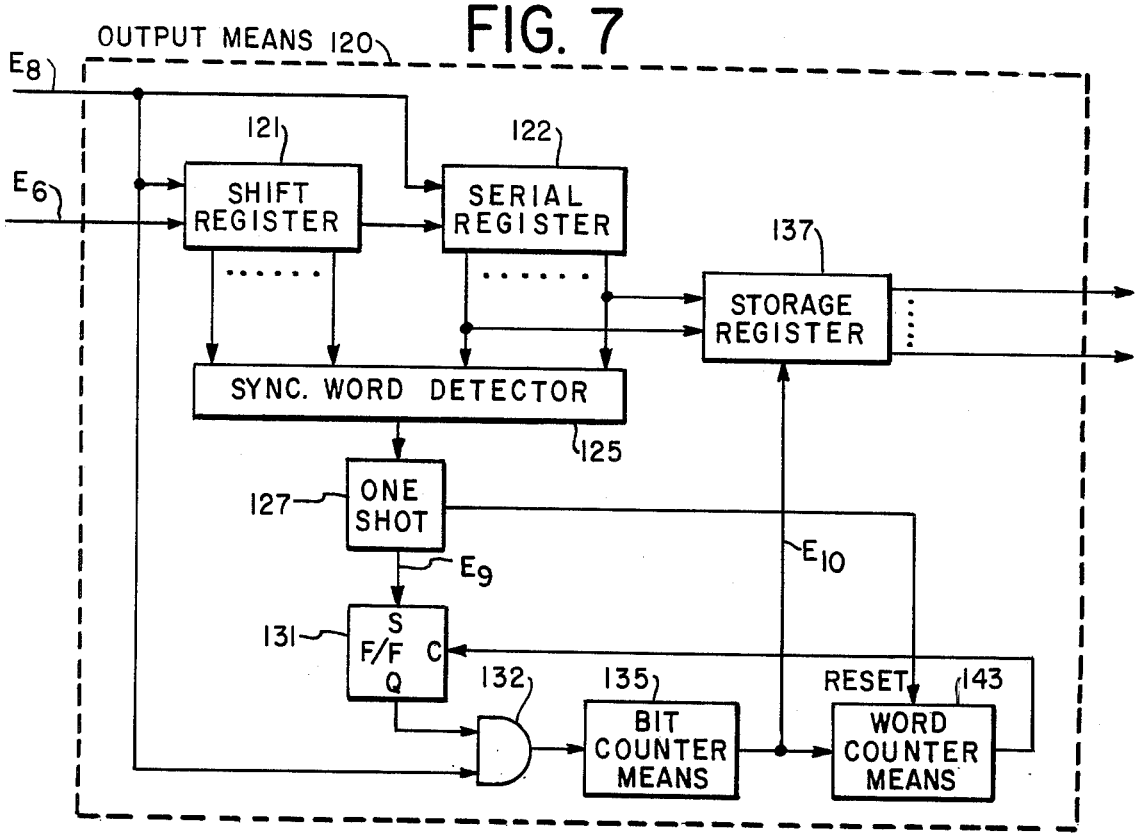

Pulses $E_8$ and digital signal $E_6$ are applied to output means 120 shown in FIG. 7. Signal $E_6$ is applied to a shift register 121 whose serial output is applied to another shift register 122. Clock pulses $E_8$ are used to shift the contents of registers 121 and 122. Registers 121 and 122 also provide parallel outputs to a sync word detector 125. Sync word detector 125 is a NAND gate logic decoder that provides an output when all the data bits are 0 and the majority bit for the zero word is 0 while the majority bit for the first word is 1. When that condition occurs, the output from detector 125 triggers a one-shot multivibrator 127 causing it to provide a sync pulse $E_9$ to a flip-flop 131, setting it and resetting word counter 143. Flip-flop 131 provides an output at a high level when in the set state, and at a low level when in the clear state. Flip-flop 130 provides its output at a high level to a NAND gate 132 thereby enabling it. Enabled, NAND gate 132 passes pulses $E_8$ to bit counter means 135. When bit counter means 135 counts sufficient bits to constitute a word, it provides an enter pulse $E_{10}$ to a storage register 137 causing register 137 to store the input provided to it by serial register 122. The enter pulses $E_{10}$ are also provided to word counter means 143 which counts the words. Upon completion of the other words in a word cycle, which in the present example is 32 words, word counter means 143 provides a pulse to flip-flop 130 clearing it so that no more enter pulses can be provided to storage register 137 until the next sync word has been detected. Storage register 137 provides parallel digital outputs corresponding to the conditions sensed in the borehole.

The system of the present invention is a transmission system for transmitting digital data from downhole to uphole. As such it includes a parallel to serial converter should digital signals it receives downhole be in parallel form. The serial data signal is then encoded so that the changing of the amplitude conveys the information rather than the amplitude. The digital signals are then decoded at the surface to provide a parallel digital output.

What is claimed is:

1. A well logging system comprising a logging tool adapted to be passed through a borehole traversing an earth formation including sensing means for sensing at least one condition of the earth formation and providing parallel digital signals corresponding to the sensed condition; converter means connected to sensing means for providing a serial digital signal wherein predetermined number of bits comprise digital words, some digital words are information words and correspond to the parallel digital signals while other digital words correspond to predetermined mined sync words; timing signal means connected to the converter means for providing timing pulses to the converter means so as to cause the converter means to provide the digital information words in a fixed predetermined relationship to the digital sync words, said timing signal means includes timing pulse means for repetitiously providing timing pulses $T_0$, $T_1$, $T_2$ and $T_3$ constituting a bit cycle, means connected to the timing pulse means for utilizing one of the timing pulses during each cycle to generate shift pulses and for providing the shift pulses to the converter means, first bit counter means connected to the timing pulse means for counting one of the timing pulses in each bit cycle of a bit pulse and providing a word pulse when the number of counter bit pulses equals a predetermined number which constitutes a digital word, first word counter means connected to the bit counter means for counting the word pulses and providing first and second pulses when the number of counted word pulses is equal to a predetermined number of digital words, and logic means connected to the timing pulse means, to the first bit counter and to the first word counter for providing an enter pulse and a reset pulse to the converter means in according with the timing pulses, other than the timing pulses used to generate the shift pulses, the word pulse and one of the pulses from the first word counter means; and phase encoding means connected to the converter means and to the timing signal means for phase encoding the serial digital signal in accordance with the timing pulses to provide a phase encoded signal, said phase encoder means includes a NOR gate connected to the converter and to the majority bit means for passing the digital data word or the majority bit, first and second NAND gates, said first NAND gate being connected to the NOR gate and receiving timing pulses $T_2$ and passed pulses from said NOR gate for passing timing pulse $T_2$ when enabled by a passed pulse from the NOR gate and for blocking the timing pulses $T_2$ when disabled by the absence of a passed pulse from the NOR gate, an inverter connected to the NOR gate for inverting the output of the NOR gate, said second NAND gate being connected to the inverter and receiving timing pulses $T_2$ for passing a $T_2$ time pulse when enabled by output from the inverter and for blocking the timing pulses $T_2$ when disabled by the output from the inverter, flip-flop means having a clear input, a preset input connected to the first and second NAND gates, respectively; and 'D' input connected to the NOR gate and a 'C' input receiving timing pulses $T_0$ for providing an output as the phase encoded signal in accordance with the presence or absence of passed pulses from the NOR gate, both NAND gates and timing pulses $T_0$; cable means for conducting electrical signals from the logging tool to surface equipment, and the logging tool also includes means connected to the phase encoder means for applying the phased encoded signal to the cable; and surface equipment includes filter means connected to the cable for filtering the phased encoded signal to compensate for distortion to the phase encoded signal caused by the cable to provide a filter signal, phase decoder means connected to the filtering means for phase decoding the filter signal to provide a second serial digital signal, corresponding to the first serial digital signal and to provide timing pulses, and output means connected to the phase decoder means for providing parallel digital signals representative of the information words and the sync words in accordance with the second serial digital signal.

2. A well logging system as described in claim 1 in which the phase decoder means includes trigger pulse means connected to the filtering means for providing a trigger pulse on change of amplitude of the signal from the filtering means; a non-retriggerable one-shot multivibrator means connected to the trigger circuit means for providing a pulse for each trigger circuit means for providing a pulse for each trigger pulse that occurs when it is in its retriggerable state; for not providing a pulse in response to a trigger when it is not in its retriggerable state; and second flip-flop means having a J input, an inverting K input connected to the filtering means and a C input, said J and K inputs being connected to the filtering means, for changing state in response to pulses from the non-triggerable one-shot multivibrator means and in accordance with the signal from the filter means and providing an output corresponding to the state of the second flip-flop means, one-shot multivibrator means connected to the non-retriggerable one-shot multivibrator means for providing pulses on a one-for-one basis in response to the pulses from the non-retriggerable one-shot multivibrator means, so as to provide shift pulses.

3. A well logging system as described in claim 2 in which the output means includes a first and second serially connected register, said first register receives the digital signal from the second flip-flop means and each register means being connected to the one-shot multivibrator means and receiving the shift pulses therefrom so that the digital signal provided by the second flip-flop means is shifted through the registers in accordance with the shift pulses and both registers provide parallel digital signals corresponding to their contents; sync word detector means connected to both registers for providing an output when both registers contain sync words; a second one-shot multivibrator means connected to the sync word detector means for providing a pulse output when the sync word detector means has detected the sync words; third flip-flop means having two inputs and providing an output whose amplitude is determined by the state the third flip-flop means is in, one input being connected to the second one-shot multivibrator means and responsive to its pulse for placing the third flip-flop means in one state; an AND gate connected to the first one-shot multivibrator means and to the third flip-flop means for passing the pulses from the first one-shot multivibrator means when enabled by the output from the third flip-flop means and for blocking those pulses when disabled by the output from the third flip-flop means; second bit counter means connected to the AND gate for counting the passed pulses and providing a word pulse every time the number of bits counted constitutes a digital word; word counter means connected to the other input of the third flip-flop means and to the bit counter means for counting the word pulses and providing an output to place the third flip-flop means in another state when the number of words corresponds to the predetermined amount of words; a third register connected to the second register and to the second bit counter means for entering the digital signals provided by the second register means upon the occurrence of a word pulse from the second bit counter means.

4. A well logging system as described in claim 3 further comprising a band-pass filtering means connected to the cable means and to the filtering means for L signal having a frequency which lies within a predetermined range of frequencies from the cable means to the filter means, and a squaring amplifier means connected to the filter means, to the trigger means and to the J and K inputs of the second flip-flop means for shaping the pulses from the filter means and providing the shaped pulses to the trigger means and to the second flip-flop means.

* * * * *